US010352539B2

(12) United States Patent
Bowden et al.

(10) Patent No.: US 10,352,539 B2
(45) Date of Patent: Jul. 16, 2019

(54) YOKE EFFECT MULTI-BEAM LIGHTING DEVICE AND SYSTEM

(71) Applicant: CHAUVET & SONS, LLC, Wilmington, DE (US)

(72) Inventors: Samuel Bowden, Nottingham (GB); Ford Hunter Sellers, Coconut Creek, FL (US); Michael Graham, Pembroke Pines, FL (US)

(73) Assignee: Chauvet & Sons, LLC, Wilmington, DE (US)

( * ) Notice: Subject to any disclaimer, the term of this patent is extended or adjusted under 35 U.S.C. 154(b) by 48 days.

(21) Appl. No.: 15/394,063

(22) Filed: Dec. 29, 2016

(65) Prior Publication Data

US 2018/0112858 A1 Apr. 26, 2018

Related U.S. Application Data

(63) Continuation-in-part of application No. 29/581,981, filed on Oct. 24, 2016, now Pat. No. Des. 836,226.

(51) Int. Cl.

| | |
|---|---|
| ***F21V 14/02*** | (2006.01) |
| ***F21V 21/15*** | (2006.01) |
| ***H05B 37/02*** | (2006.01) |
| ***F21V 21/30*** | (2006.01) |
| ***F21V 29/74*** | (2015.01) |
| *F21V 21/005* | (2006.01) |
| *F21Y 113/13* | (2016.01) |
| *F21Y 115/10* | (2016.01) |
| *F21V 21/14* | (2006.01) |

(52) U.S. Cl.

CPC ..... *F21V 21/15* (2013.01); *F21V 21/30* (2013.01); *F21V 29/74* (2015.01); *H05B 37/0254* (2013.01); *F21V 14/02* (2013.01); *F21V 21/005* (2013.01); *F21V 21/14* (2013.01); *F21Y 2113/13* (2016.08); *F21Y 2115/10* (2016.08)

(58) Field of Classification Search

CPC ..... F21W 2102/30; F21W 2103/30; F21W 2131/406; F21V 14/02; F21V 21/14; F21V 21/15; F21V 21/30; F21V 29/54; F21Y 2113/13; F21Y 2115/10; H05B 37/0254

See application file for complete search history.

(56) References Cited

U.S. PATENT DOCUMENTS

| | | | | |
|---|---|---|---|---|
| 5,590,955 A * | 1/1997 | Bornhorst | F21S 10/06 | 362/232 |
| 5,758,955 A * | 6/1998 | Belliveau | F21S 10/00 | 362/293 |
| 7,614,766 B2 * | 11/2009 | Wang | F21V 14/02 | 248/183.1 |
| 2003/0137840 A1 * | 7/2003 | Citron | F21V 21/30 | 362/249.07 |
| 2004/0165385 A1 * | 8/2004 | Belliveau | F21V 21/15 | 362/272 |
| 2012/0091917 A1 * | 4/2012 | Vinther | F21S 10/023 | 315/312 |

(Continued)

*Primary Examiner* — Zheng Song

(74) *Attorney, Agent, or Firm* — Laurence A. Greenberg; Werner H. Stemer; Ralph E. Locher

(57) ABSTRACT

A yoke effect, multi-beam lighting device is provided. The yoke includes a plurality of bays, one for each beam head. Each beam head of the yoke is individually controllable and configured to tilt in the yoke independent of the other beam heads.

19 Claims, 8 Drawing Sheets

(56) References Cited

U.S. PATENT DOCUMENTS

| | | | | |
|---|---|---|---|---|
| 2015/0062902 | A1* | 3/2015 | Velazquez | F21V 21/14<br>362/249.07 |
| 2016/0313636 | A1* | 10/2016 | Chien | G03B 29/00 |
| 2018/0051869 | A1* | 2/2018 | Belliveau | F21V 21/15 |

* cited by examiner

YOKE EFFECT MULTI-BEAM LIGHTING DEVICE AND SYSTEM

CROSS-REFERENCE TO RELATED APPLICATIONS

The present application claims priority to U.S. patent application Ser. No. 29/581,981, filed on Oct. 24, 2016, that application being incorporated herein, by reference, in its entirety.

BACKGROUND OF THE INVENTION

Field of the Invention

The present invention relates to yoke effect, multi-beam lighting device and system and, more particularly, to a yoke effect lighting device in which each beam head can be autonomously controlled separately from the other beam heads.

Description of the Related Art

Previously, the current assignee produced a moving light array with five independently controlled heads, under the trademark INTIMIDATOR™ WAVE IRC, as illustrated in FIG. 1. Referring now to FIG. 1, the moving light array 10 has five independently tilting, barrel-shaped heads 20 supported in a multi-bay yoke or frame 15. Each head 20 is rotatable from 0° to 270° about an axis through its individual bay 30. In other words, the heads 20 are not fully rotatable (i.e., 0° to 360°) in their bays 30. As a consequence, each head 20 must stop and switch directions to change the lighting coverage the front of the device 10 to the back of the device 10. The process of moving the head all the way forward, and then all the way backwards requires more time than if the head were to fully rotate within its bay 30. Also, this directional movement limitation significantly limits the lighting effects created by the device 10. Additionally, the constant movement of the heads 20 all the way in one direction and then abruptly stopping and reversing direction until the heads 20 reach the stopping point on the other end and then abruptly stopping and reversing again puts continuous stresses on the electrical and mechanical components, thereby increasing the wear and tear and maintenance costs and decreasing the life of the device 10.

What is needed is a multi-beam, moving light array that permits full, continuous and infinite rotation or tilting (i.e., 360+ degrees) of each head in both directions, independently of the other heads. What is further needed is a multi-beam light array that, in addition to providing full, continuous and infinite tilting of each head relative to one another, provides individualized control of the lighting effects of each head. The ability to continuously tilt each head in both directions, independently of the other heads, and to individually control the lighting effects of each head, will allow lighting designers and programmers that control the purchasing decisions for concert tours, theater shows, clubs and other events and venues to create visual lighting effects that are not capable of being produced by prior art fixtures.

BRIEF SUMMARY OF THE INVENTION

The present invention is particularly suited to overcome those problems which remain in the art in a manner not previously known or contemplated. It is accordingly an object of the invention to provide a yoke effect, multi-beam lighting array that includes a plurality of heads that can be continuously rotated infinitely (360°)+ in their yoke bays, in both directions.

Although the invention is illustrated and described herein as embodied in a yoke effect, multi-beam lighting product and system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The foregoing background, as well as the following detailed description of the preferred embodiments, is better understood when read in conjunction with the appended drawings. For the purpose of illustrating the invention, there is shown in the drawings an exemplary embodiment that is presently preferred, it being understood however, that the invention is not limited to the specific methods and instrumentality's disclosed. Additionally, like reference numerals represent like items throughout the drawings. In the drawings.

DETAILED DESCRIPTION OF THE INVENTION

Figure 1:
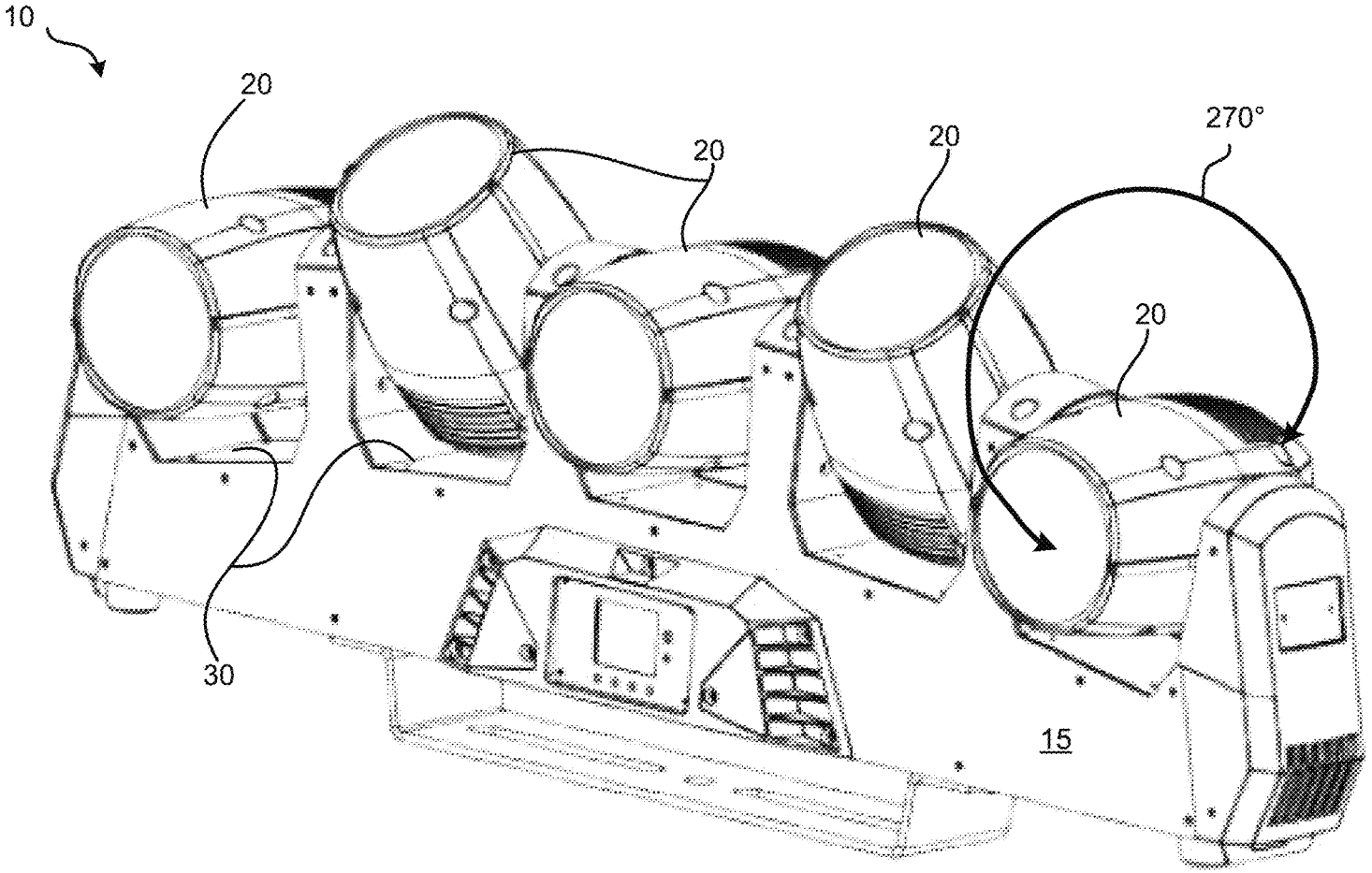
FIG. 1 PRIOR ART
FIG. 1 is a perspective view of a yoke effect, multi-beam lighting device according to the prior art.
Figure 2A:
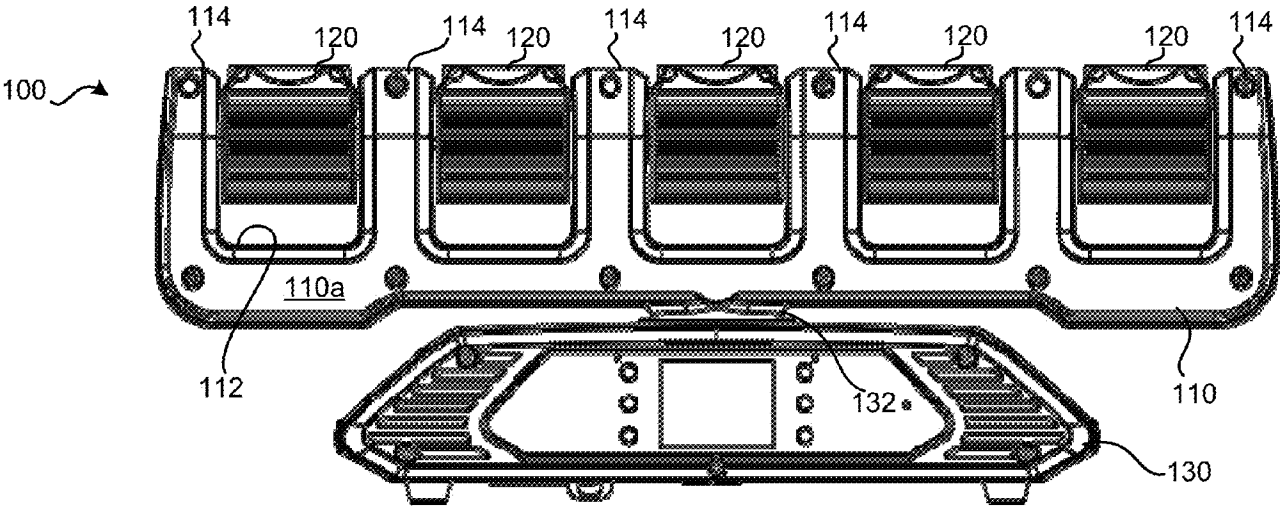
FIG. 2A is a front plan view of a yoke effect, multi-beam lighting device in accordance with one particular embodiment of the invention.
Figure 2B:
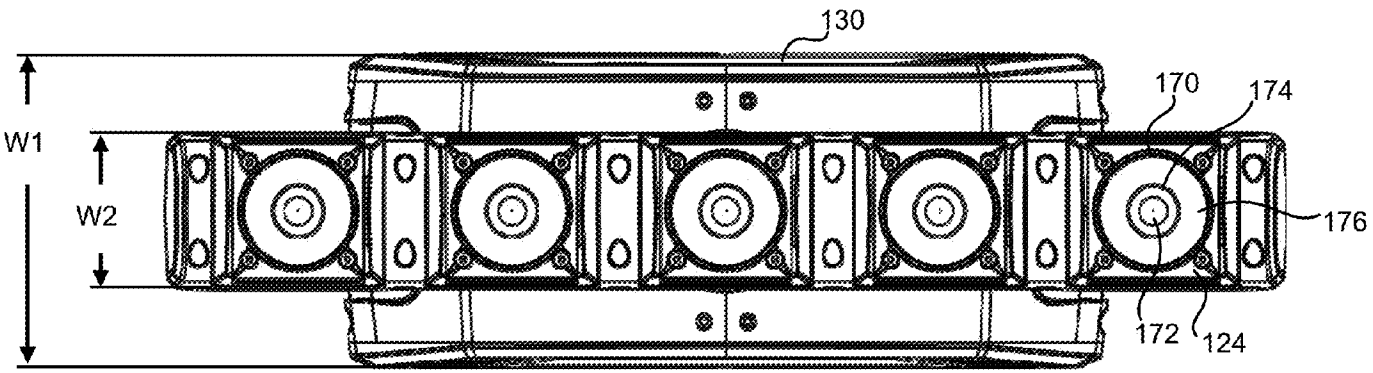
FIG. 2B is a top plan view of the yoke effect, multi-beam lighting device of FIG. 1A.
Figure 2D:
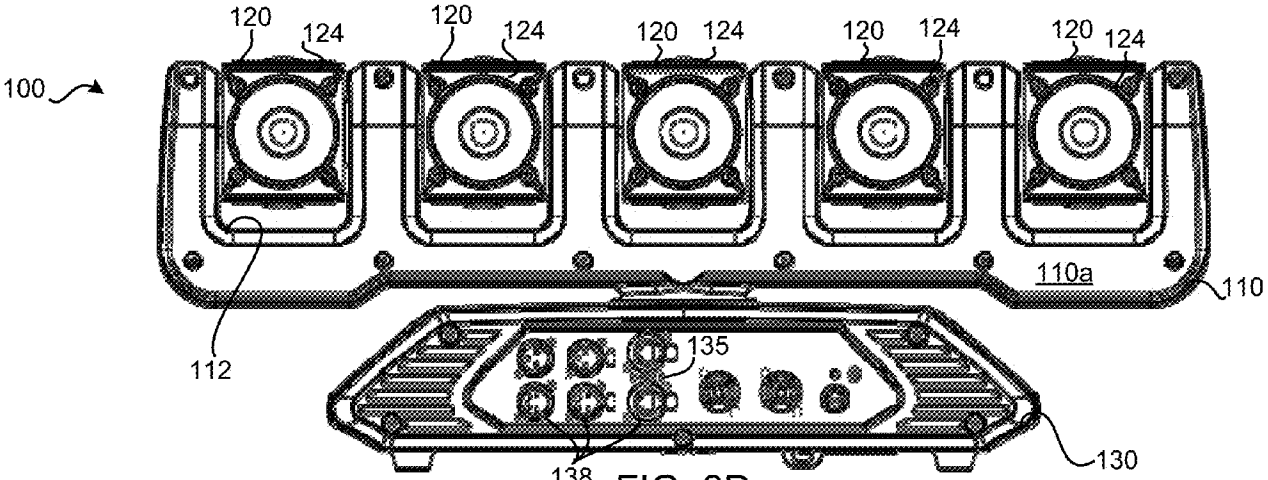
FIG. 2D is a rear plan view of a yoke effect, multi-beam lighting device in accordance with one particular embodiment of the invention.
Figure 2C:
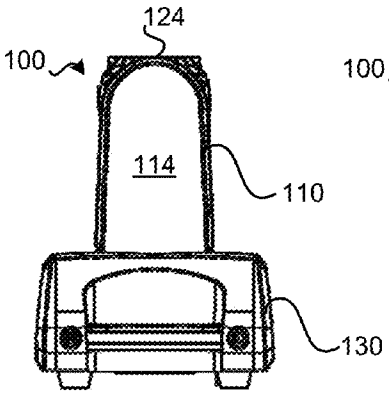
FIG. 2C is a side or end plan view of the yoke effect, multi-beam lighting device of FIG. 2A.

Before explaining the disclosed embodiment of the present invention in detail, it is to be understood that the invention is not limited in its application only to the details of the particular arrangement shown since the invention is capable of other embodiments. Also, the terminology used herein is for the purpose of description and not of limitation.

Referring now to FIGS. 2A-6B, there is illustrated a yoke effect, multi-beam lighting device 100, in accordance with one particular embodiment of the present invention. The lighting device 100 includes a base 130 supporting a multi-bay yoke 110 having a plurality of individually controllable beam heads or lighting pods 120. The multi-bay yoke 110 includes a plurality of "U"-shaped bays 112 defined between two adjacent arms 114, with one bay 112 for each beam head 120 of the device 100. One advantageous feature of the present invention is that each head 120 in the yoke 110 is individually controllable from, and can tilt 360 degrees relative to, every other head 120 in the yoke 110.

Individual Motor Control of Each Beam Head Tilt:

Each beam head 120 is rotatably mounted, at opposite sides of the beam head 120, to an arm 114 of a bay 112. These two mounting points define an axis of rotation 116 about which each head 120 tilts. In the present preferred embodiment, the heads 120 are all aligned on the same axis 116, as illustrated more particularly in FIG. 3B. However, if desired, the heads 120 can be offset in the yoke 110, such that all heads 120 do not rotate about the same axis.

Figure 3A:
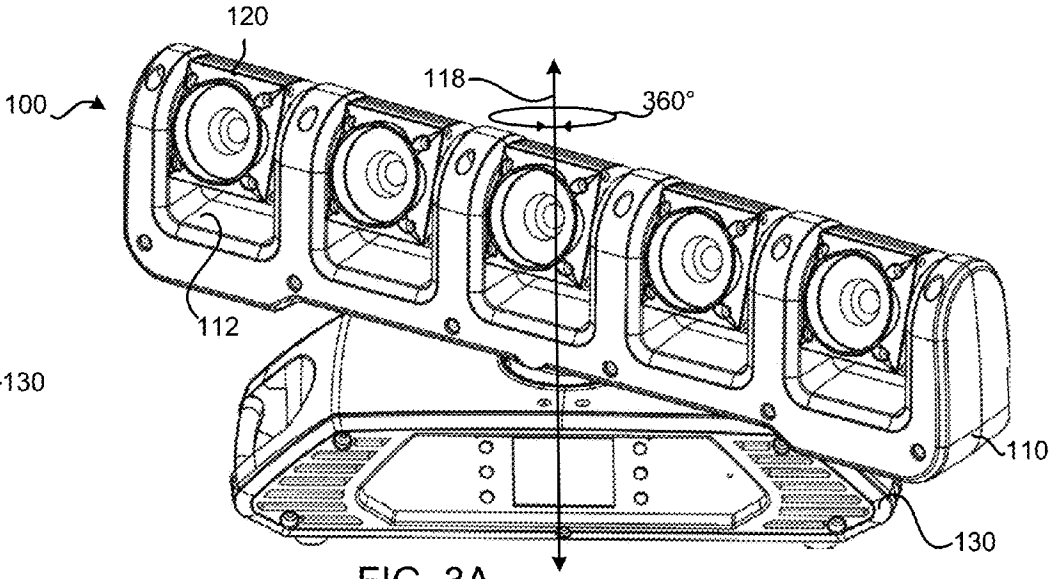
FIG. 3A is a front, perspective view of a yoke effect, multi-beam lighting device in accordance with one particular embodiment of the invention, useful in explaining the pan of the yoke.
Figure 3B:
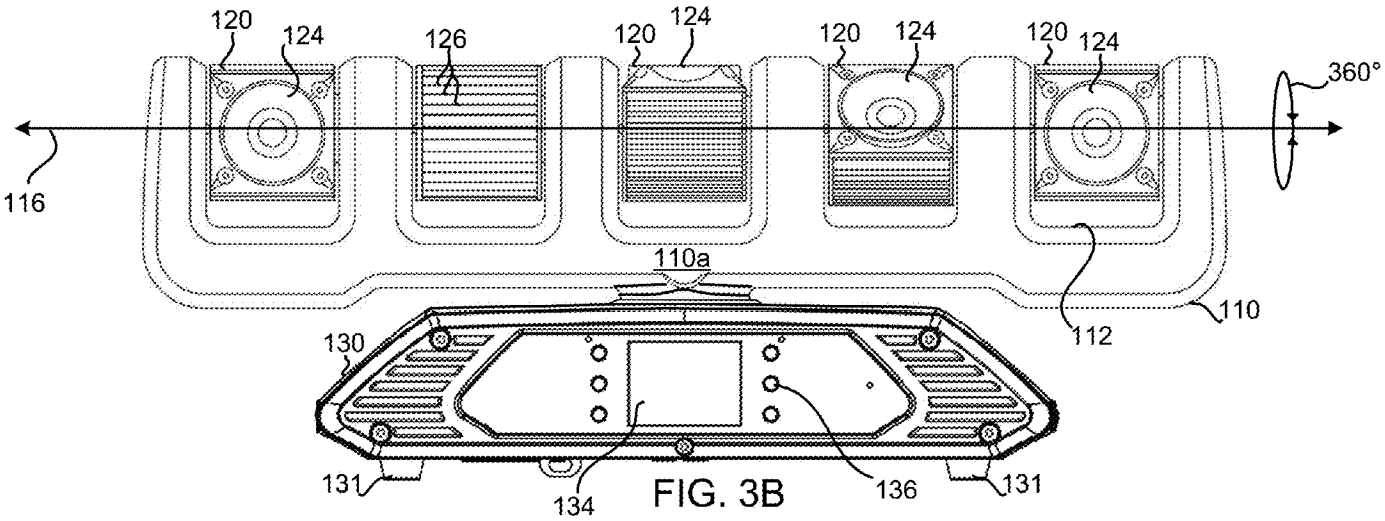
FIG. 3B is a front, plan view of a yoke effect, multi-beam lighting device in accordance with one particular embodiment of the invention, useful in explaining the independent tilt of the individual beam heads.
Figure 4B:
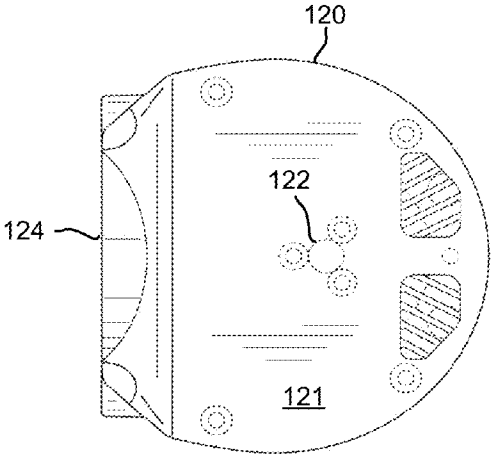
FIG. 4B is a side, plan view of the beam head, in accordance with one particular embodiment of the invention.
Figure 4A:
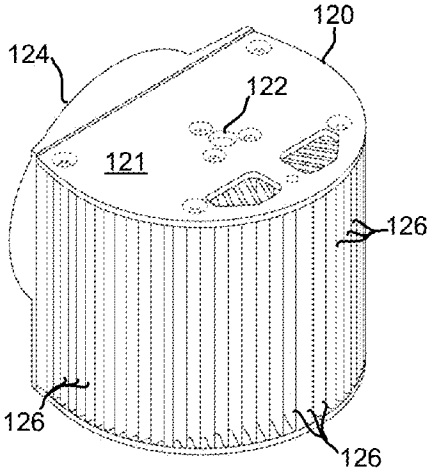
FIG. 4A is a rear, perspective view of a beam head, in accordance with one particular embodiment of the invention.
Figure 5A:
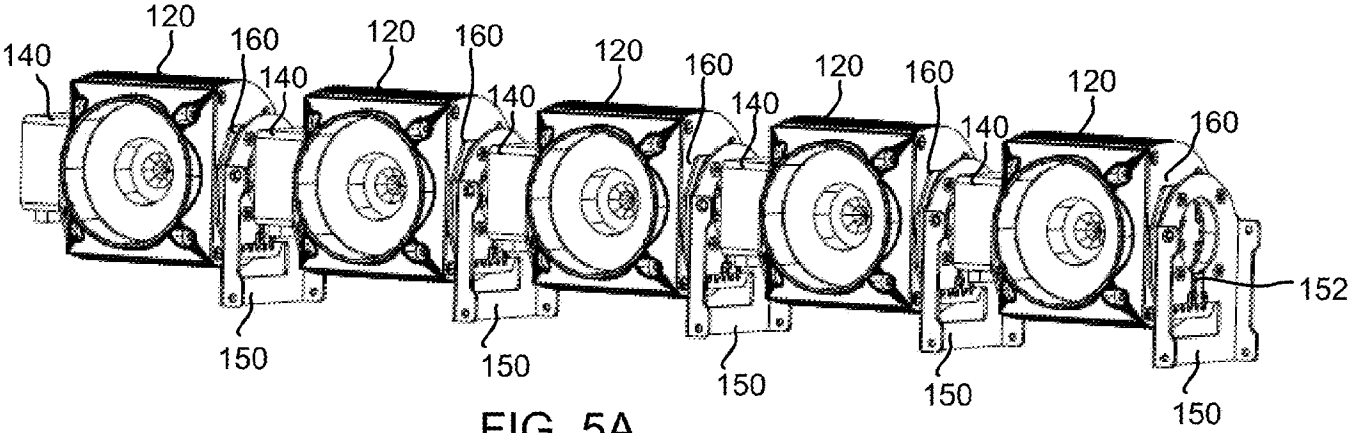
FIG. 5A is a front, perspective view of the beam heads and a portion of the internal structure of the yoke, in accordance with one particular embodiment of the invention.
Figure 5B:
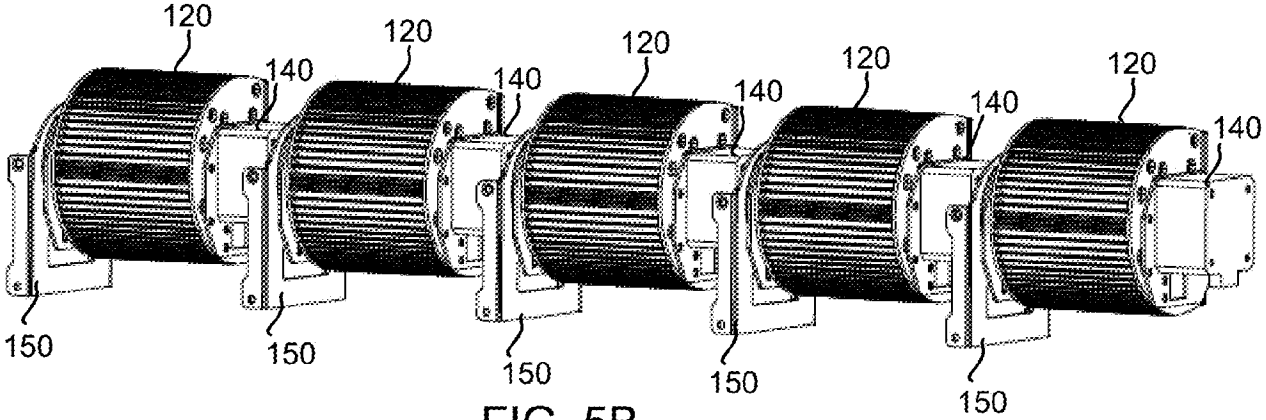
FIG. 5B is a rear, perspective view of the beam heads and portion of the internal yoke structure of FIG. 5A.

Each arm 114 of the multi-bay yoke 110 includes a bracket 150 (FIGS. 5A-6B), to which the heads 120 are connected. More particularly, one side of each head 120 is connected to a bracket 150 via a motor 140, which drives that head 120 independently from the other heads 120. The other side of each head 120 is connected to a bracket 150 via a swivel bearing 160. Thus, in the present exemplary embodiment, five motors 140 are provided to drive the five heads 120. The motor 140 includes a motor shaft that passes through a hole 122 on a side of the head 120. In one particular embodiment of the invention, the motor shaft includes a pinion gear and/or splines at the distal end that engage teeth of an annular or ring gear mounted inside the head 120 around the hole 122. A swivel bearing 160 is connected between the other side of the head 120 and the bracket 150, thus permitting the head 120 to rotate about an axis 116 (drawn through the center of the motor shaft and the center of the bearing 160), when driven by the motor 140. Due to the individual motors 140, each head 120 can move independently from the other heads 120 about the axis 116, as illustrated in FIG. 3B.

In the present invention, each head 120 is configured to tilt 360+ degrees about the axis 116 in its bay 112. In other words, each head 120 can tilt continuously and infinitely about the axis 116, thus fully encircling the axis 116 as many times as desired, without having to stop at the base of the yoke or be driven in an opposite direction in order to direct the beam from the front side to the back side of the device 100. The device 100 is further configured so that each individual head 120 can move or spin continuously and infinitely in either direction about the axis 116, as desired.

Figure 6A:
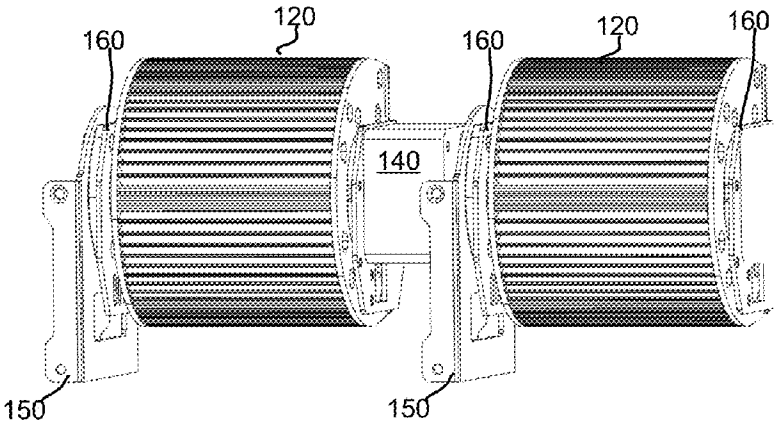
FIGS. 6A and 6B are enlarged, partial perspective views of beam heads in their relative position to a portion of the internal structure of the yoke, in accordance with one particular embodiment of the invention.
Figure 6B:
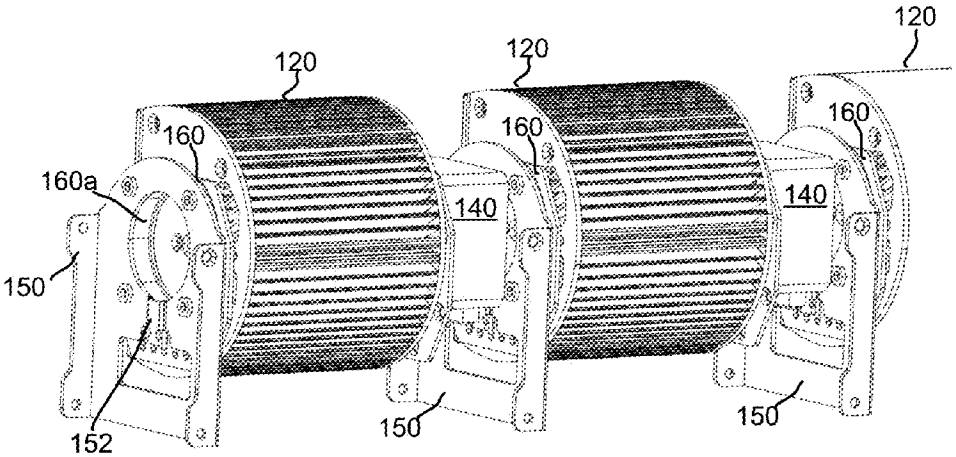

As illustrated more particularly in FIG. 6B, each bracket 150 includes a wire bundle receiver 152, to receive signal and power wires for the motor 140 and lighting unit 170.

The Head Design:

Each of the heads 120 is particularly designed to permit full, continuous and infinite 360°+ rotation in the yoke bays 112 in both directions. One particularly advantageous feature of the invention is the truncated-ovoid cross-section of the heads. As can be seen more particularly in FIG. 4B, the heads 120 have a generally egg-shaped or ovoid cross-section, from front to back, which is truncated or cut off at the top face 124 of the head 120, for the lens and light window aperture—hence the term "truncated-ovoid". The sides 121 of the head 120 are flat, for attachment into the yoke 110, facing the arms 114, as described above. The compact, truncated-ovoid shape of the head 120 is sized to permit full rotation of the head 120 within the bay 112, without any part of the head 120 contacting the cross arm 110*a* of the yoke 110.

Each head 120 includes a lighting unit 170 visible through the top face 124. The lighting unit 170 includes, among other things, a lighting element 172, a reflector 174 and a window lens 176. In one particular embodiment, the lighting element 172 is an RGBW LED lighting element.

Additionally circuitry 190 for controlling the lighting element 170 is provided inside the head 120. As the head 120 is designed to rotate 360°+, power and control signals can be provided to the circuitry 190 (FIG. 7) inside the head 120 using a slip ring or other rotating electrical connector 180 (FIG. 7) disposed through the hole 122, via a central opening 160*a* of the swivel bearing 160. As discussed above, a hole 122 on the opposite side of the head 120 receives a motor shaft of the motor 140, for driving the head 120.

A further advantageous feature of the head 120 is that the ovoid shaped surface of the body of the head 120 is provided with heat sink fins, in order to eliminate a fan within the head 120, itself. More particularly, the increased surface area provided by the fins 126 aids in dissipating heat from within the head 120, resulting from the electrical circuit and lighting element contained therein. In one particular embodiment of the invention, the heads 120 are made from a heat conducting material to further aid in dissipating the heat. The ability of the head 120 to self-dissipate heat without a fan from within the head 120 allows the head 120 to contain the lighting element and to continuously rotate 360°+ while projecting light.

The Base Design:

The base 130 of the lighting device 100 is designed to support the yoke 110 and to provide control signals and/or power to the lighting units 170 and motors 140, thereof. The yoke 110 connects to the base 130 by a neck portion 132 which is configured to permit the entire multi-bay yoke 110 to pan about an axis 118 extending longitudinally through the neck portion 132. As with each head 120, the neck portion can be driven by a motor in the base and have a coupling configured to permit the yoke 110 to pan continuously (i.e., 360°+) in either direction about the axis 118. A further slip coupling or rotating electrical connector can be used to provide power and control signals from the base 130 to the yoke 110.

The base 130 is configured to provide a stable support for the rotating (i.e., panning) yoke 110. In one embodiment, the width "W1" of the base 130 is greater than the width "W2" of the yoke 110. In one particular embodiment, W1 is nearly twice W2 (e.g., W1=179 mm, while W2=89 mm). If desired, rubber feet 131 may be provided for further stability.

The Control Processor:

Additionally, in the present preferred embodiment, a control processor 200 for operating the device 100 is contained within the base 130. The control processor 200 can receive both digital and manual inputs. To this end, the base 130 provides an input interface to the control processor 200. For example, base 130 includes a touchscreen display 134 and menu buttons 136 (i.e., six menu buttons in the illustrated embodiment) for providing manual inputs to the control processor 200. A menu can be navigated by pressing the buttons 136, touching images of the buttons on the sides of the touchscreen display 134 or touching the desired menu options on the display 134 directly. The touchscreen display 134 can be locked and calibrated through a setup option in a menu. Additionally, the touchscreen display 134 can be used to select various control settings and lighting effects, including selecting pre-programmed lighting program macros stored in memory of the control processor 200 or lighting program macros created by the user and stored in memory.

The rear of the device 100 (i.e., the side opposite from the touchscreen display) is provided with a plurality of input and output ports 138. In one particular embodiment of the invention, the device 100 can receive DMX, ART-NET™, sACN or Kling-Net signals. In a further exemplary embodiment, the device 100 is provided with 2 Neutrik® ether CON® through ports 138, and 3- and 5-pin DMX IN and OUT ports. Various indicators and informational LEDS 135 may additionally be provided.

Figure 7:
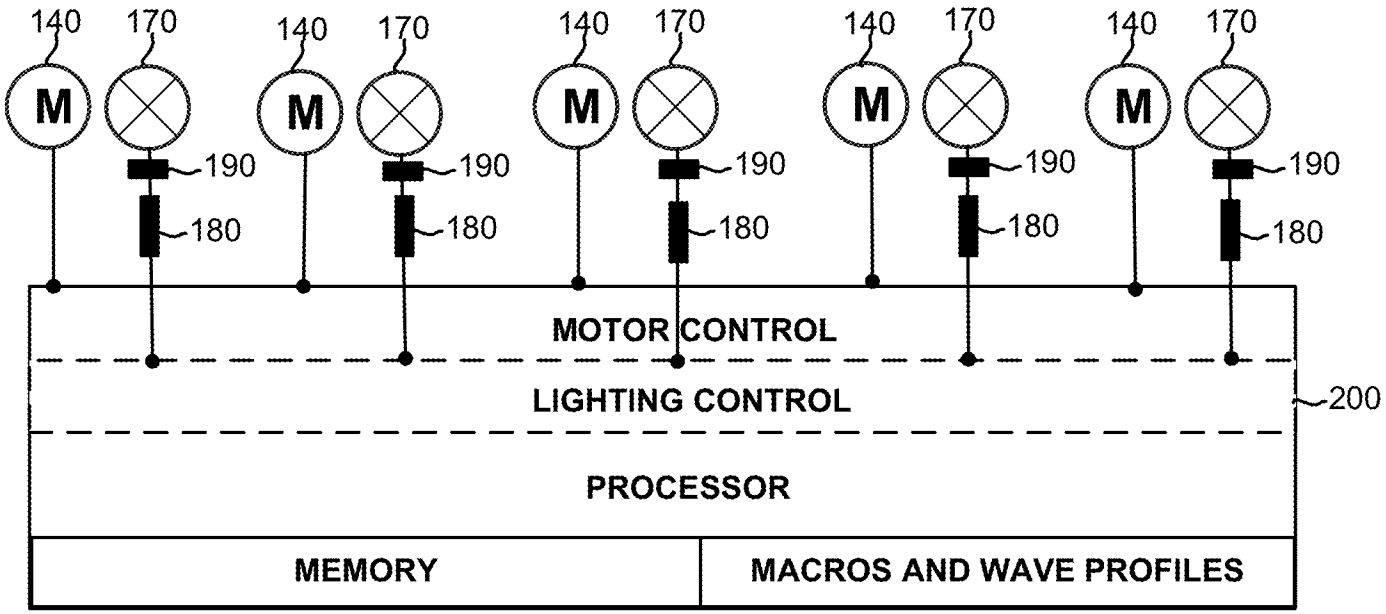
FIG. 7 is a simplified block diagram of a control system for a yoke effect, multi-beam lighting device, in accordance with one particular embodiment of the invention.

As illustrated more particularly in FIG. 7, the control processor 200 of the present embodiment includes working memory and non-transitory program storage memory, in which software executed by the processor, and stored color (lighting) and tilt macros, are stored. The processor is configured, through execution of the stored software, to provide motor control and lighting control for the device 100. In other words, the control processor operates in accordance with input requests to provide control signals to operate the motors 140 and light elements 172.

Among other things, the control processor 200 can operate to control color control of the lighting elements 172 through the control of pixel values to the lighting elements 172. As discussed above, in one particular embodiment of the invention, the lighting elements 172 in each head are RGBW LEDs. The control processor 200 of the present embodiment is configured for pixel mapping. In particular, the control processor 200 is configured to provide pixel values for setting a color value for each of the five RGBW LEDs provided in the device 100, according to user requests or stored macros. Other lighting effects (i.e., tilt, dimming, color, on/off, etc.) can likewise be set for each individual lighting element 172, independently of every other lighting element. Alternately, the heads 120 can be controlled together, if desired.

Additionally, the control processor 200 can adjust the frequency, offset of starting point and amplitude of lighting effects based on programmed waves, which may be assigned independently to each head 120 and lighting element 172. For instance, a sine wave may be applied to the brightness of each color, RGBW in the lighting element 172, across multiple heads 120. It may be desirous that the frequency applied to each color be at different values. Thus the color produced by the lighting element 172 will vary. By sending different frequency and amplitude values to each of the lighting elements 172, an effect can be created that makes each lighting element 172 have a different color pattern. Alternatively, the same values can be sent to multiple lighting elements 172, with the starting values offset, thereby creating a chasing style color effect which appears to travel through the fixture. The same can be done with the tilt function, allowing for instance the ability to make wave and fan style effects by applying a sine wave, or a can-can style effects by applying a square wave. The size, speed, and offset of the starting point of each of these waves can be adjusted to allow the fixture to create varied color, brightness, and movement effects. In one particular embodiment of the invention, the control processor 200 is configured to employ 16-bit dimming of the lighting elements 172. Such dimming can be performed by employing pulse width modulated waveforms programmed into the system.

Figure 8:
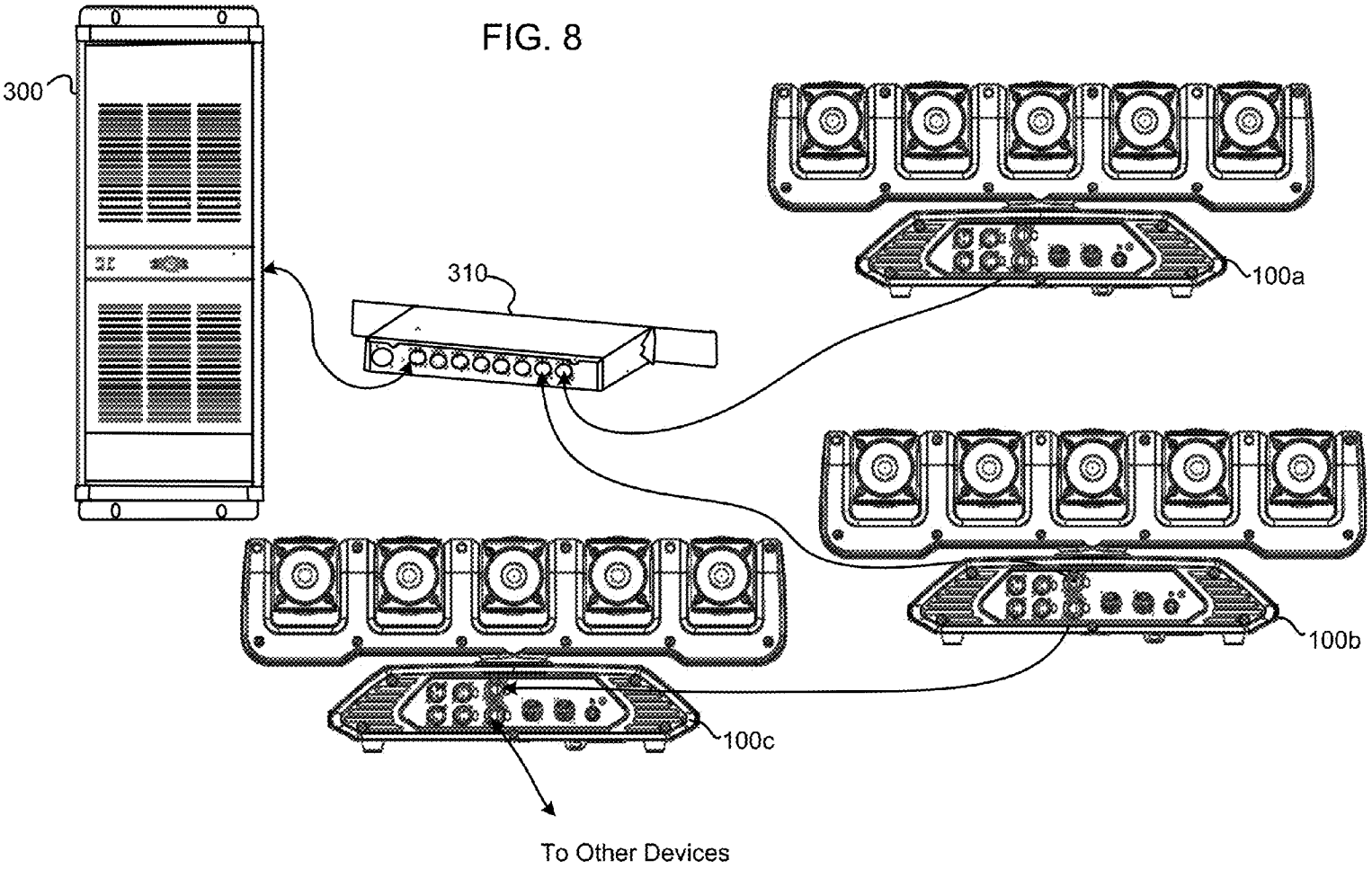
FIG. 8 is a block diagram of a system using a yoke effect, multi-beam lighting device in accordance with one particular embodiment of the invention.

The control processor is additionally configured to operate in master/slave mode, to be used with other devices. Referring now to FIG. 8, there is illustrated a network wherein the devices 100 are programmed and/or controlled by an external computer/controller 300 that provides a control signals to the devices 100, via a switch or router 310. The control signals may be of a type according to one or more digital lighting protocols, such as DMX, Art-Net™, sACN and/or Kling-Net. More particularly, the computer/controller 300 provides programming and/or control signals to the stand-alone device 100*a* and the device 100*b*, configured as a master device controlling the slave device 100*c*. In this configuration, the device 100*b* provides control signals and/or power to the slave device 100*c*, which in turn operates as a master for other devices down the line.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended. For example, although the use of five beam heads is illustrated in the present application, it is intended that the invention not be limited only thereto, as fewer or more beam heads can be attached to a multi-bay yoke without deviating from the scope and spirit of the present invention. Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

We claim:

1. A lighting device, comprising:

a base;

a yoke connected to said base, said yoke including a plurality of bays positioned along a longitudinal axis of said yoke, wherein said yoke pans relative to said base;

a plurality of beam heads;

exactly one beam head of said plurality of beam heads is rotatably mounted in each bay of said plurality of bays about a rotation axis defined through said bay parallel to said longitudinal axis of said yoke, wherein each beam head of said plurality of beam heads is configured to be tilted in said bay at least 360° about said rotation axis independently of said yoke, and independently of each other beam head of said plurality of beam heads;

each beam head including at least one lighting element therein; and a controller configured to pan said yoke relative to said base and to tilt each beam head of said plurality of beam heads independently of every other beam head of said plurality of heads.

2. The lighting device of claim 1, wherein each head of said plurality of heads is configured to be tilted in said one bay at least 360° about said rotation axis in both directions.

3. The lighting device of claim 2, wherein said controller is configured to tilt at least one of said beam heads about said rotation axis in one direction at the same time as at least one of said other beam heads tilts about said rotation axis in an opposite direction.

4. The lighting device of claim 1, wherein the rotation axes for said plurality of beam heads are collinear.

5. The lighting device of claim 1, wherein said yoke includes a plurality of motors with one motor being mounted in one arm of each bay adjacent each beam head.

6. The lighting device of claim 1, wherein each beam head has a truncated-ovoid cross section.

7. The lighting device of claim 6, wherein at least one outer surface of each beam head includes a plurality of heat sink fins.

8. The lighting device of claim 1, wherein said controller uses a programmed wave to control at least one of a frequency, start point offset and amplitude of a lighting effect.

9. The lighting device of claim 1, wherein said yoke is configured to pan at least 360° relative to said base.

10. A method of controlling a lighting fixture, comprising the steps of:

providing a lighting fixture according to claim 1;

operating the lighting fixture to tilt said plurality of beam heads independently of one another, with at least one beam head tilting at least 360° relative to at least one other beam head.

11. The method of claim 10, further comprising the steps of:

controlling at least one of the color and intensity of the lighting element of one beam head of said plurality of beam heads independently of the other beam heads of said plurality of beam heads.

12. The method of claim 11, wherein a lighting effect of said lighting element is controlled by said controller according to programmed waves controlling an amplitude of said lighting effect.

13. The lighting device of claim 1, wherein each beam head of said plurality of beam heads is configured to be tilted in said bay continuously about said rotation axis.

14. The lighting device of claim 1, wherein each beam head of said plurality of beam heads is configured to be tilted in said bay continuously and infinitely in either direction about said rotation axis.

15. A lighting device, comprising:

a yoke including a plurality of bays positioned along a longitudinal axis of said yoke;

a plurality of beam heads, each beam head of said plurality including at least one lighting element therein;

each beam head having a truncated-ovoid cross-section;

exactly one beam head of said plurality of beam heads is rotatably mounted in each bay of said plurality of bays about a rotation axis defined through said bay parallel to said longitudinal axis of said yoke, wherein said truncated-ovoid cross-section and said bay are configured to permit each beam head of said plurality of beam heads to be tilted in said bay at least 360° about said rotation axis; and a controller configured to tilt each beam head of said plurality of beam heads independently of every other beam head of said plurality of heads.

16. The lighting device of claim 15, wherein at least one outer surface of each beam head includes a plurality of heat sink fins.

17. The lighting device of claim 16, further including a multi-bay yoke, wherein each beam head of said plurality of beam heads is mounted in one bay of said multi-bay yoke.

18. The lighting device of claim 17, wherein two opposing sides of said beam head are flat and have said at least one outer surface between them.

19. The lighting device of claim 17, wherein each bay of said plurality of bays comprises two arms supporting said beam head and includes a motor in one of said two arms, said motor driving said beam head.

* * * * *